United States Patent [19]

Vandeputte

[11] Patent Number: 4,957,106

[45] Date of Patent: Sep. 18, 1990

[54] GAS MASK COUPLED TO MONOLITHIC MEMBER WITH SPEECH MEMBRANE

[75] Inventor: Gilbert Vandeputte, Berchem, Belgium

[73] Assignee: Engicom, Naamloze Vennootschap, Brussels, Belgium

[21] Appl. No.: 273,127

[22] Filed: Nov. 17, 1988

Related U.S. Application Data

[63] Continuation of Ser. No. 24,999, Mar. 12, 1987, abandoned.

[30] Foreign Application Priority Data

Mar. 12, 1986 [BE] Belgium ..... PV2/60937

[51] Int. Cl.[5] ..... A62B 18/08

[52] U.S. Cl. ..... 128/201.19; 128/205.24; 128/206.28; 128/912

[58] Field of Search ..... 128/205.27, 205.29, 128/206.12, 206.15, 206.17, 201.22, 201.23, 201.24, 201.25, 201.28, 206.28, 201.12, 201.19, 9.2, 206.27, 204.18, 205.24, 205.25, 205.28

[56] References Cited

U.S. PATENT DOCUMENTS

| | | | |
|---|---|---|---|
| 1,366,437 | 1/1921 | Wagenhorst | 128/202.15 |
| 2,008,677 | 7/1935 | Booharin | 128/206.17 |
| 2,133,345 | 10/1938 | Davis | 128/201.15 |
| 2,199,231 | 4/1940 | Schwartz | 128/206.17 |
| 2,344,920 | 3/1944 | Maggi | 128/201.19 |
| 2,820,651 | 1/1958 | Phillips | 128/204.18 |
| 3,042,033 | 7/1962 | Early et al. | 128/204.26 |
| 3,181,531 | 5/1965 | Angioletti | 128/201.19 |
| 3,348,537 | 10/1967 | Miller et al. | 128/201.19 |
| 3,635,217 | 1/1972 | Potash | 128/201.19 |
| 3,850,168 | 11/1974 | Ferguson et al. | 128/206.27 |
| 3,978,854 | 9/1976 | Mills, Jr. | 128/912 |
| 4,173,220 | 11/1979 | Ratz et al. | 128/201.19 |
| 4,373,520 | 2/1983 | Arbique | 128/206.15 |
| 4,549,543 | 10/1985 | Moon | 128/206.17 |
| 4,595,003 | 6/1986 | Shoemaker et al. | 128/201.19 |
| 4,718,415 | 1/1988 | Bolnberger et al. | 128/201.19 |
| 4,756,308 | 7/1988 | Ryback | 128/201.19 |

FOREIGN PATENT DOCUMENTS

| | | |
|---|---|---|
| 687036 | 1/1940 | Fed. Rep. of Germany . |
| 811036 | 4/1937 | France . |
| 837355 | 6/1960 | United Kingdom . |

OTHER PUBLICATIONS

Webster's Dictionary, 1984, p. 766.

*Primary Examiner*—Max Hindenburg
*Assistant Examiner*—J. P. Lacyk
*Attorney, Agent, or Firm*—Michael N. Meller

[57] ABSTRACT

Gas mask mainly composed of an inlet and outlet part (1) with possibly a speaking membrane (9), fastening devices (2) for securing the inlet and outlet part (1) before the mouth and nose orifices and a filter connection part (3), which is rotatable towards the inlet and outlet part.

7 Claims, 2 Drawing Sheets

GAS MASK COUPLED TO MONOLITHIC MEMBER WITH SPEECH MEMBRANE

This application is a continuation, of application Ser. No. 24999, filed 3/12/87 now adandoned The present invention concerns a gas mask.

Known gas masks are mainly composed of an inlet and outlet and a speaking membrane which are separately disposed in fastening devices whereby these fastening devices can secure the inlet and outlet parts of aforesaid inlet and outlet before the mouth and nose orifices, and of a filter connection element which makes it possible to secure a filter on the inlet part. The fastening devices for the face mask may accommodate of eye glasses or a panoramic sight glass and possible other accessories.

Moreover it is also known that the inlet and outlet parts of such gas masks have each at least one check valve and may have several other fittings.

Such devices have one disadvantage in that the maintenance is made difficult by the large number of separate parts. Another disadvantage in assembly during manufacturing and, still another disadvantage in that control of the correct functioning of the gas mask require a relatively long time.

It is also known that the existing filters are relatively heavy and bulky. This can result for the mask user in limitation of head movements, to a reduction of the sight field, which is already quite limited in the case of masks, to quickly increasing fatigue of neck muscles caused by the applied couple and to the difficult or even impossible use of instruments, tools or devices.

The present invention thus provides an alternative solution for a gas mask which systematically eliminate the disadvantages of the known gas masks. To this end the invention is a gas mask characterized by the fact that it is mainly composed of an inlet and an outlet part, of fastening devices in order to secure the inlet and outlet parts before the mouth and nose orifices and of a filter connection part whereby the inlet and the outlet parts are particularly and mainly composed of one single piece. Further, the gas mask in accordance with the invention is characterized by the fact that the filter connection part can be rotated towards the inlet and outlet part. The use of a monolithic inlet and outlet part or common inlet and outlet part has the advantage that the gas masks are easy to manufacture and that their correct functioning can be easily checked. The use of a rotatable filter connection piece has the advantage that the relatively heavy filter can be easily displaced from an inconvenient position by bringing it into another position.

In a first preferred embodiment this gas mask comprises a monolithic inlet and outlet part and a filter connection part which can be rotated in all directions whereby the filter connection part is connected to the inlet and outlet part by means of a ball joint.

According to a second preferred embodiment, the rotatable filter connection part is able to rotate in one plane. The connection between the inlet and outlet part, on the one hand, and the filter connection part on the other hand, is achieved in this case by means of a pivotable elbow-shaped coupling part. One end of this coupling part is always turned to the mouth of the gas mask user while the filter connection part is mounted on the other end. In these two preferred embodiments the inlet and outlet part has of specific advantages which will be more clearly described hereafter.

For the sake of better understanding of the characteristics of the invention two embodiments will be described hereafter as examples without any limitative character and with reference to the figures, FIG. 1 is a first embodiment of the gas mask according to the invention.

Figure 1:
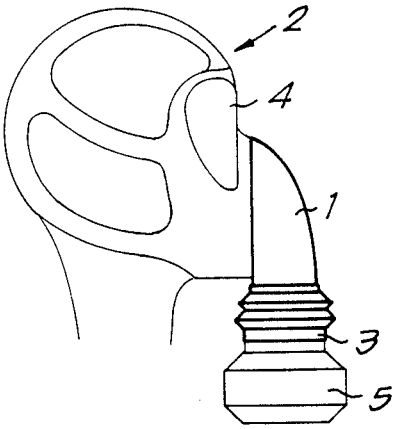

As illustrated on FIG. 1 the gas mask is mainly composed of an inlet and outlet part 1, of fastening device 2, in order to secure the inlet and outlet part 1 before the mouth and nose orifices and a filter connection part 3. The fastening device 2 is already known and may be composed for instance of a face mask which is equipped with eye glasses 4 or possibly with a panoramic sight glass. In the filter connection part 3, different kinds of filters 5 may be used and are selected in accordance with the application involved.

Figure 2:
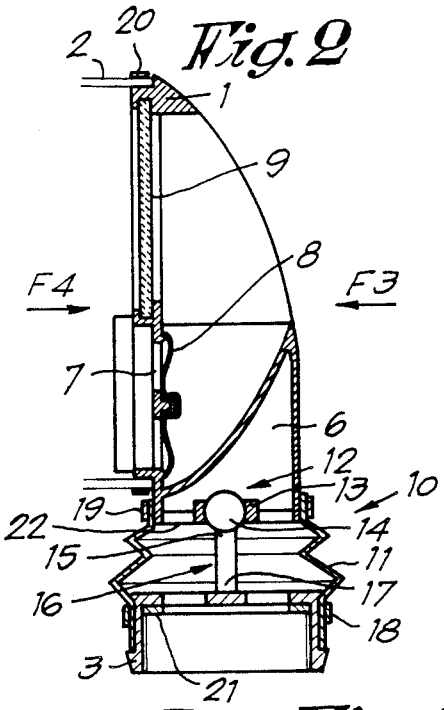
FIG. 2 is a cross section through the inlet and outlet part and the filter connection part of the gas mask of FIG. 1.
Figure 3:
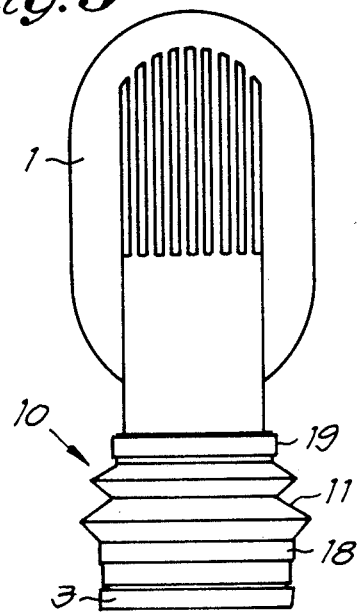
FIG. 3 is a view following the arrow F3 of FIG. 2.
Figure 4:
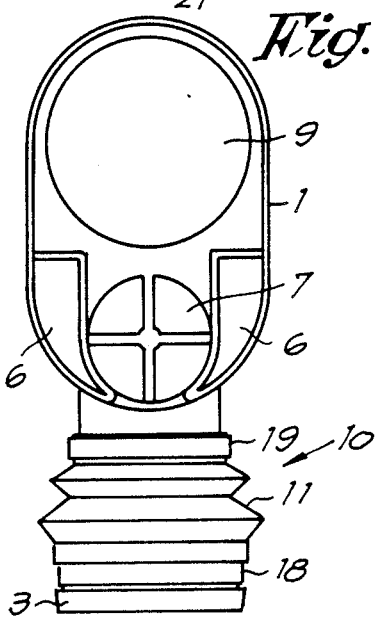
FIG. 4 is a view following the arrow F4 of FIG. 2.

The specific character of the invention consists in the fact that the inlet and outlet part 1, as illustrated on FIGS. 2 to 4 is made of one single piece. This monolithic element is mainly composed of several inlet channels 6 and of an outlet orifice 7 which can be shut-off by means of a venting valve 8. The inlet and outlet part 1 can be also be equipped for instance, with a speaking membrane 9. This inlet and outlet part 1 may, however, be also equipped with other accessories such as a device for absorbing liquid food, a second speaking membrane for a telecommunication connection, and transpiration drainage system.

Another specific characteristic of the invention consists in the fact that the filter connection part 3 is rotatable towards the inlet and outlet part 1 whereby the filter connection part 3, with the filter 5 fastened on it, is designed in such a way that the latter one can keep its last position. To this end coupling devices 10 are mounted between the filter connection part 3 and the inlet and outlet part 1, as illustrated in FIGS. 1 to 4, whereby these devices are made, for instance, of a flexible air supply line 11 and of a ball joint 12. The flexible air supply pipe is made preferably of a bellow.

The first part 13 of the ball joint 12 is a part of the inlet and outlet part 1. The second part 14 which is, the ball is fastened on the end 15 of rod 16 whereby this rod 16 is supporting the filter connection part 3 on its opposite end 17.

Several clamping straps 18 to 20 must be also employed in order to secure, the flexible air supply pipe 11, the face mask on the inlet and outlet part 1 and the filter connection part 3. Moreover a sealing member 21 must also be mounted into the filter connection part 3.

The functioning of the gas mask according to FIGS. 1 to 4 can be easily understood by examining this latter figure. If the ball joint 12 is made tightly enough, we get the advantage that the filter connection part 3 as well as the filter 5 may be located in whichever position in order that the annoyance for the gas mask user becomes very limited.

In an alternative not illustrated in the figures, the coupling device 10 may be a large ball joint having a central aperture and a hollow shape. The ball of the ball joint may be, for instance, the continuation of the lowest end 22 of the inlet and outlet part 1 while the casing of the ball joint is monolithic with the filter connection part 3.

Further, the coupling device 10 may also be made of a cross-coupling.

Still further, the coupling device 10 may be composed of the flexible air supply pipe 11 only. This flexible pipe is, constructed strong enough to retain its last position in spite of the weight of the filter 5.

Figures 5, 6:
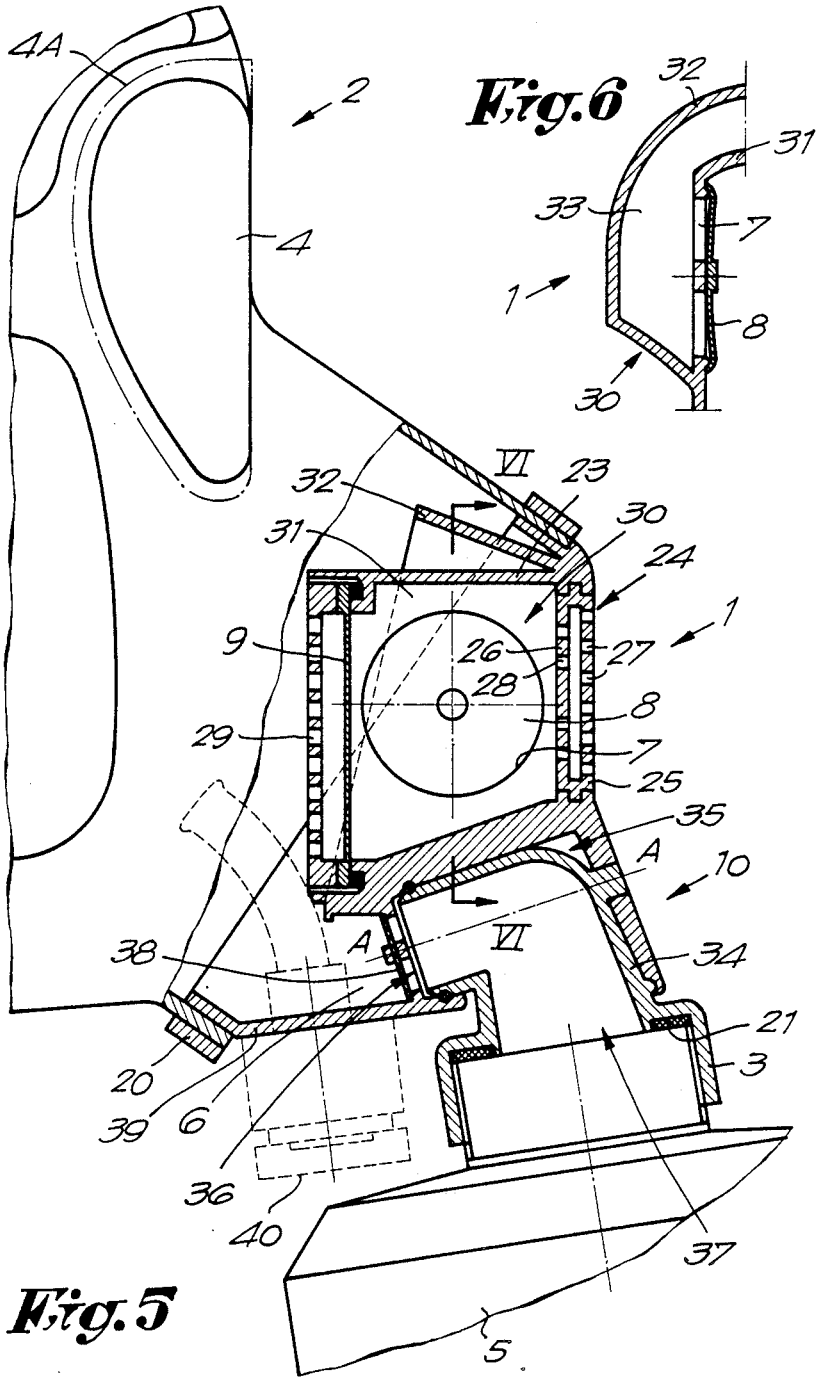
FIG. 5 is a second embodiment of the gas mask according to the invention.
FIG. 6 is a cross-section following the lines VI—VI of FIG. 5.

FIGS. 5 and 6 illustrate another preferred embodiment of the invention with a very compact inlet and outlet part 1. The inlet and outlet part 1 is mainly composed in this case of a casing 23.

The front side of the casing 23 is made of a double grid 24 whereby both grid parts 25 and 26 are designed in such a way that their respective grid apertures 27 and 28 are not overlapping eachother. The double grid 24 has the advantage that jets, for instance water jets, cannot penetrate into the inlet and outlet part and damage the speaking membrane 9.

The rear side of the casing 23 is made of the speaking membrane 9 and of a grid 29 located on the side of the user's face in order to protect the membrane 9. As the speaking membrane 9 is located directly before the mouth, the acoustic vibrations can be carried to the outside without difficulty.

The casing 23 is equipped with double-wall sides 30 which are made of respectively one inside wall 31 and one outside wall 32. The intermediate space 33 is in connection with the inside of the gas mask. On both sides of the casing 23 in the inside wall 31 an outlet aperture 7 is mounted and sealed by means of a venting valve 8. The exhalated air can be evacuated this way through the venting valve, the outlet of the casing 23 and the double grid 24. The use of two inlet apertures 7 has the advantage that the resistance opposed to respiration is reduced.

The rotatable filter connection part 3 of FIG. 5 can be turned by 180° in one plane. The coupling devices 10 are made of an elbow-shaped coupling part 34 rotatable around an axis A-A as well as an adequate seat 35. Preferably the seat 35 is designed a tight fit for the coupling part 34. One end 36 of this coupling part 34 is oriented to the face of the mask user while the second end 37 is turned downwards and is the filter connection part 3.

As also illustrated in FIG. 5 the seat 35 is preferably mounted under the casing 23 in order to achieve a compact system.

Near the end 36 of the coupling part 34 an inlet valve 38 is mounted.

On the bottom face of the inlet and outlet part, a device retention means 39 is provided in order to permit the insertion of an auxiliary part 40 for food supply and evacuation of transpiration moisture. The means 39 are, for instance, a support plate.

The casing 23, the seat 35 and the means 39 are preferably made of one single pressure cast part. This has the advantage that a strong assembly is achieved. Moreover there is one single opening in the mask because all fittings are located in the same monolithic element.

The invention also includes of a rotatable connection part 3 but which doesn't have, on the other hand, any monolithic inlet and outlet part, as is the case with gas masks which include a combination of both characteristics.

The present invention is by no way limited to the embodiments described by way of examples and illustrated by the figures but such a gas mask as well as its components can be made with any shape and sizes without departing from the scope of the invention.

I claim:

1. A gas mask comprising a facepiece with a seat, a monolithic member having wall means made of rigid material and a plurality of seats formed therein, means for mounting said monolithic member in said seat of said facepiece, inlet opening means, outlet valve means, and speech membrane means each mounted in respective seats of said monolithic member, and an axis defined as being normal to the surface of and extending through the center of said inlet opening means and a coupling member pivotably mounted on said monolithic member for pivoting about said axis, said coupling member having an inlet opening and an outlet opening, said outlet opening connected with said inlet opening means and said inlet opening of said coupling member traveling along an arc during pivoting of said coupling member about said axis.

2. The gas mask as defined in claim 1, wherein said wall means, said outlet valve means and said speech membrane means define a cavity in said monolithic member, said cavity communicating with the environment external to said gas mask by way of aperture means, the interior of said gas mask communicating with said cavity by way of said outlet valve means.

3. The gas mask as defined in claim 2, wherein said outlet valve means comprises first and second outlet valves arranged on opposing sides of said cavity, each of said outlet valves allowing gas to vent from said interior of said gas mask to said cavity and blocking the flow of gas from said cavity to said interior of said gas mask.

4. The gas mask as defined in claim 2, wherein said aperture means comprise a first plurality of apertures formed in a first grid and a second plurality of apertures formed in a second grid, said first and second grids being rigidly coupled to each other and mounted in one of said seats of said monolithic member, and said first plurality of apertures not overlapping with said second plurality of apertures, said aperture means and said speech membrane means being arranged on opposing sides of said cavity.

5. The gas mask as defined in claim 2, further comprising a third grid having a third plurality of apertures, said third grid being mounted in another seat of said monolithic member and being arranged on the interior side of said speech membrane means.

6. The gas mask as defined in claim 1, further comprising filter means coupled to said coupling member, said inlet opening of said coupling member communicating with said filter means.

7. The gas mask as defined in claim 1, further comprising means for food intake coupled to one of said seats in said monolithic member.

* * * * *